US006433662B1

(12) United States Patent
Ikoma et al.

(10) Patent No.: US 6,433,662 B1
(45) Date of Patent: Aug. 13, 2002

(54) SOLENOID ACTUATOR

(75) Inventors: Kouichi Ikoma; Atsushi Umemoto; Minoru Torii, all of Saitama-ken (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/695,134

(22) Filed: Oct. 25, 2000

(30) Foreign Application Priority Data

Oct. 28, 1999 (JP) ..... 11-307614

(51) Int. Cl.[7] ..... H01F 3/00

(52) U.S. Cl. ..... 335/256; 251/129.15; 439/651

(58) Field of Search ..... 439/638, 652, 439/653, 651; 361/735; 336/192, 198; 251/129.01, 129.15, 129.2, 129.21, 129.22; 335/256–257, 271–276, 220–229, 252; 123/90.11, 90.6

(56) References Cited

U.S. PATENT DOCUMENTS 4,742,988 A * 5/1988 Haneda et al. ..... 439/692
6,157,277 A * 12/2000 Bulgatz et al. ..... 335/220
6,176,208 B1 * 1/2001 Tsuzuki et al. ..... 123/90.11

FOREIGN PATENT DOCUMENTS

DE 3102032 A1 * 8/1982

* cited by examiner

*Primary Examiner*—Lincoln Donovan
(74) *Attorney, Agent, or Firm*—Arent Fox Kinter Plotkin & Kahn

(57) ABSTRACT

There is provided a solenoid actuator which is easy to carry out wiring work for coils thereof, and at the same time allows reduction of manufacturing costs through common application of a fixed wiring. A solenoid actuator is supplied with electric power from a power source, for generating an electromagnetic force to drive a driven member such that the driven member performs reciprocating motion. Two electromagnets each have a coil and arranged such that they are opposed to each other and spaced from each other. An armature is connected to the driven member, and arranged between the two electromagnets, for performing reciprocating motion in accordance with energization and deenergization of the two electromagnets to thereby drive the driven member such that the driven member performs the reciprocating motion. Two terminals are connected to opposite ends of said coil of said each of said two electromagnets, and arranged such that the two terminals protrude outward from each of the two electromagnets, respectively. A connector has four metal connectors electrically connectible to the power source. Each two of the metal connectors are connected to the terminals of the each of the two electromagnets, by effecting engagement between the each two of the metal connectors and the two terminals of the each of the two electromagnets in a direction parallel to a direction of the reciprocating motion of the armature.

4 Claims, 8 Drawing Sheets

SOLENOID ACTUATOR

BACKGROUND OF THE INVENTION

1. Field of the Invention

This invention relates to a solenoid actuator for reciprocatingly driving a driven member by electromagnetic forces of two electromagnets.

2. Description of the Prior Art

Conventionally, a solenoid actuator of this kind is known which is applied to a valve-actuating mechanism for driving an intake or exhaust valve of an internal combustion engine to open and close the intake or exhaust valve. The valve-actuating mechanism has been proposed e.g. in Japanese Laid-Open Patent Publication (Kokai) No. 11-126715, which includes an armature connected to the intake or exhaust valve, and upper and lower electromagnets for vertically attracting the armature. The armature reciprocates between the upper and lower electromagnets whereby the intake or exhaust valve is driven to open or close. Further, in this kind of solenoid actuator which uses two electromagnets, to the coil of each electromagnet, two electric wires, hence a total of four electric wires, are connected from a lateral side, for supplying electric power thereto.

However, in the solenoid actuator described above, the valve-actuating mechanism of the internal combustion engine is limited in size, and hence space for wiring is also limited. It is not easy to carry out wiring work for the four electric wires within this limited space, and puts a large burden on workers. Further, the distance between the coils of the two electromagnets varies between a plurality of valve-actuating mechanism different in valve lift amount, which makes it impossible to apply the same electrical wiring to them. This increases the manufacturing costs of the engine.

SUMMARY OF THE INVENTION

It is an object of the invention to provide a solenoid actuator which is easy to carry out wiring work for coils thereof, and at the same time allows reduction of manufacturing costs through common application of a fixed wiring.

To attain the above object, the present invention provides a solenoid actuator supplied with electric power from a power source, for generating an electromagnetic force to drive a driven member such that the driven member performs reciprocating motion, comprising:

two electromagnets each having a coil and arranged such that the two electromagnets are opposed to each other and spaced from each other;

an armature connected to the driven member, and arranged between the two electromagnets, for performing reciprocating motion in accordance with energization and deenergization of the two electromagnets, to thereby drive the driven member such that the driven member performs the reciprocating motion;

two first metal connector elements connected to opposite ends of the coil of the each of the two electromagnets, and arranged such that the two first metal connector elements protrude outward from the each of the two electromagnets; and a connector having four second metal connector elements electrically connectible to the power source, each two of the second metal connector elements being connected to the two first metal connector elements of the each of the two electromagnets, by effecting engagement between the each two of the second metal connector elements and the two first metal connector elements of the each of the two electromagnets in a direction parallel to a direction of the reciprocating motion of the armature.

According to this solenoid actuator, by effecting engagement between each two of the second metal connector elements of the connector and the two first metal connector elements of each of the two electromagnets, the first metal connector elements and the second metal connector elements corresponding thereto are connected to each other, whereby the coils of the electromagnets became electrically connected to the power source. In this case, the work of providing wiring for the coils of the two electromagnets can be carried out by causing the second metal connector elements of the connector to be engaged with the first metal connector elements of the electromagnets in a direction parallel to the direction of reciprocating motion of the armature, and the work for removing the wiring can be carried out only by effecting the disengagement between the first and second metal connector elements. This makes it possible to carry out the work for providing or removing the wiring even when there is limited space in a direction orthogonal to the direction of reciprocating motion of the armature. Further, since the engaging direction in which the connector is engaged with the electromagnets is parallel to the direction of reciprocating motion of the armature, by properly setting the length of each of the first and second connector metal elements along the engaging direction, and a distance between two pairs each consisting of the each two of the second metal connector elements, it is possible to accommodate variation in the distance between the two electromagnets among different solenoid actuators which are different in stroke of the driven member, whereby the connector of a single kind can be commonly applied to the different solenoid actuators. This makes it possible to reduce the manufacturing costs of the solenoid actuators. In the state of the solenoid actuator having the coils of the two electromagnets connected to the power source, as described above, in accordance with energization and deenergization of the two electromagnets, effected by causing and inhibiting supply of electric power from the power source to the electromagnets, the armature is caused to perform reciprocating motion, whereby the driven member is driven for the reciprocating motion.

Preferably, the each of the two electromagnets each includes a bobbin having the coil wound therearound, the two first metal connector elements being terminals arranged on the bobbin, and the connector is in a form of a rectangular column and has one end face, another end face opposite to the one end face, and a cut-away portion formed by cutting away a parallelepiped portion therefrom, the cut-away portion having a wall facing toward and parallel to the another end face, the four second metal connector elements being arranged in two first openings formed in the another end face of the connector and two second openings formed in the wall facing toward the another end face.

More preferably, the connector has four third openings formed in the one end face, the third openings having third metal connector elements respectively arranged therein , the third metal connector elements being electrically connected respectively to two of the four second metal connector elements arranged within the two first openings and two of the four second metal connector elements arranged within the two second openings, the third openings receiving terminals of a cable connected to the power source.

More preferably, the bobbin has a first brim having an end and a second brim, as well as a terminal portion projecting outward from the end of the first brim, and the terminals arranged on the bobbin projects perpendicularly from the terminal portion.

The above and other objects, features, and advantages of the invention will become more apparent from the following detailed description taken in conjunction with the accompanying drawings.

DETAILED DESCRIPTION

The invention will now be described in detail with reference to the drawings showing an embodiment thereof. In the embodiment, a solenoid actuator according to the invention is applied to a valve-actuating mechanism of a vehicle engine, not shown, having four valves per cylinder.

Figure 1:
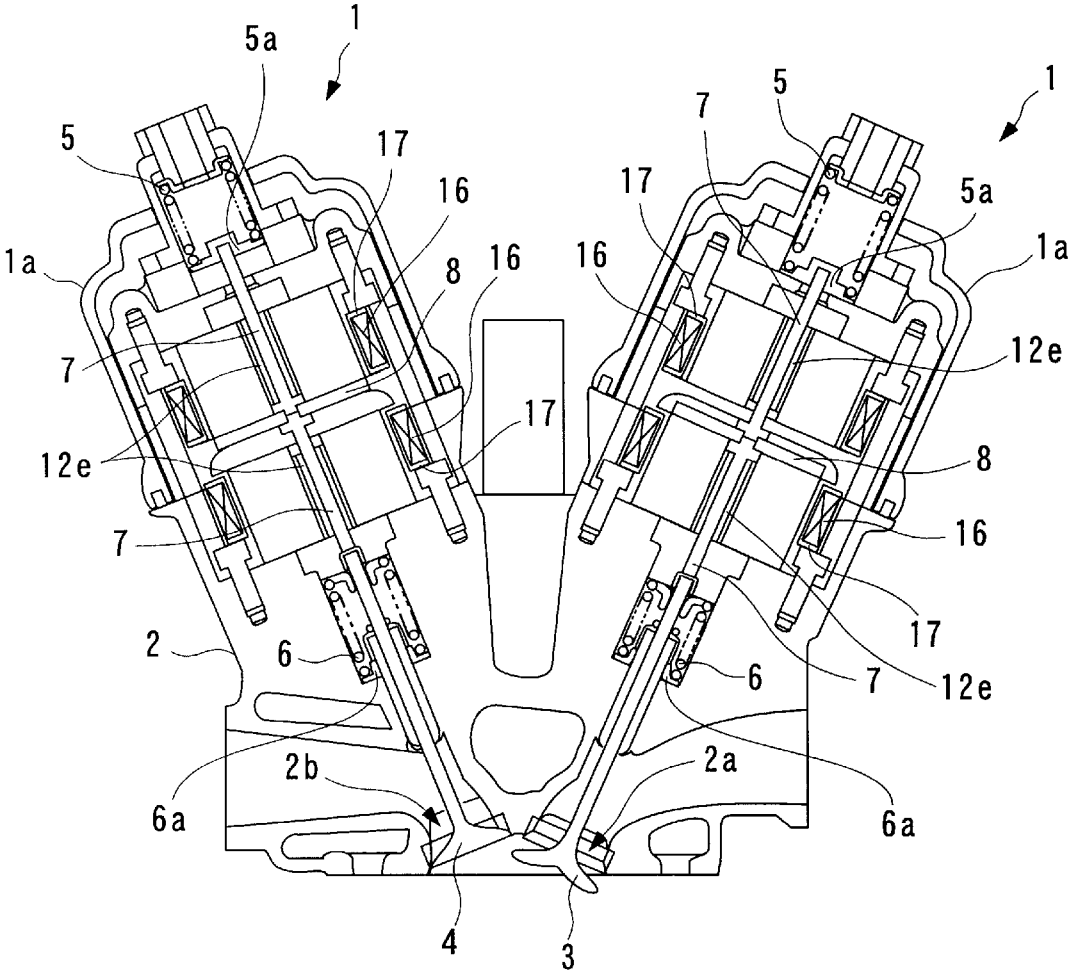
FIG. 1 is a sectional view of a valve-actuating mechanism of a vehicle engine to which is applied a solenoid actuator according to an embodiment of the present invention.

Referring first to FIG. 1, the valve-actuating mechanism is comprised of a pair of solenoid actuators 1, 1 mounted in a cylinder head 2 of the vehicle engine. During operation of the engine, the solenoid actuator 1 arranged on the right-hand side as viewed in the figure drives two intake valves 3, 3 as driven members (only one of them is shown in the figure), thereby opening and closing two intake ports 2*a*, 2*a* (only one of them is shown in the figure) of the engine, while the solenoid actuator 1 arranged on the left-hand side as viewed in the figure drives two exhaust valves 4, 4 as driven members (only one of them is shown in the figure), thereby opening and closing two exhaust ports 2*b*, 2*b* (only one of them is shown in the figure) of the same.

These two solenoid actuators 1, 1 are identical in construction to each other, so that the following description will be made by taking the right-hand solenoid actuator 1 for driving the intake valves 3 as an example. Further, for convenience of description, sides indicated by B and B' of a two-headed arrow B–B' in FIG. 2 are referred to as the "front" side and the "rear" side, respectively, while sides indicated by C and C' of a two-headed arrow C–C' are referred to as the "left" side and the "right" side, respectively.

Figure 2:
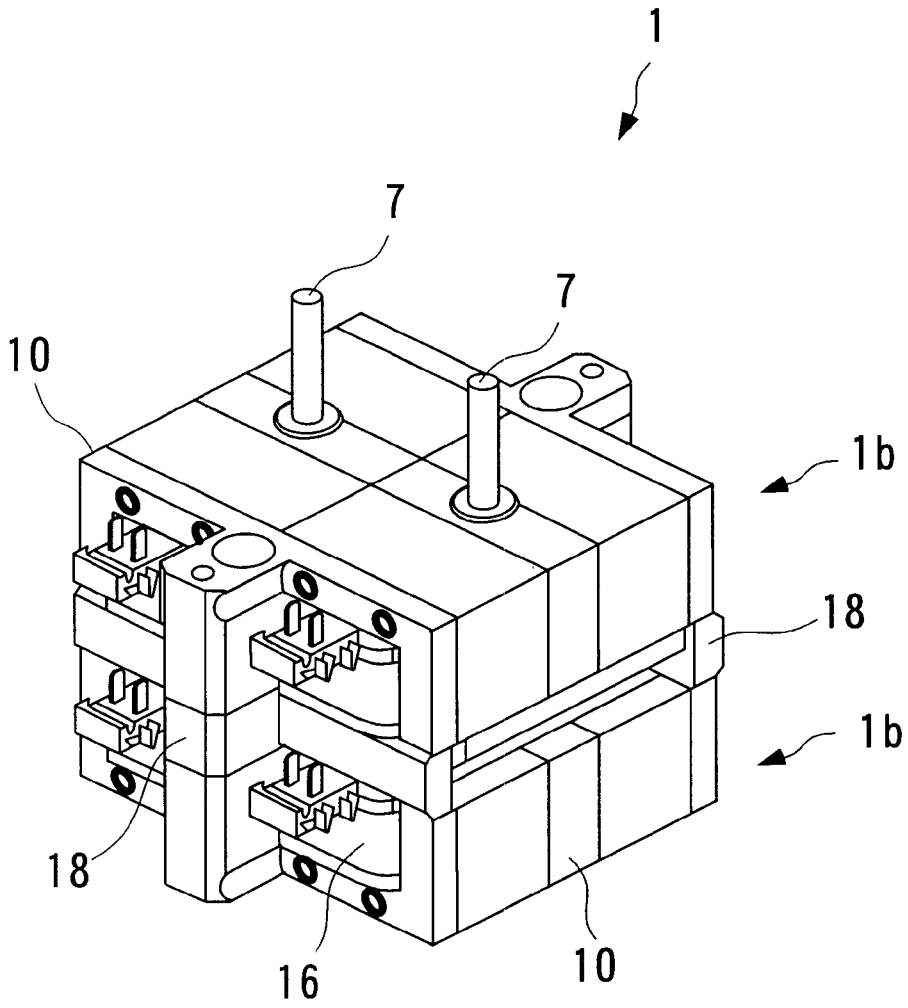
FIG. 2 is a perspective view of the solenoid actuator appearing in FIG. 1.
Figure 2:
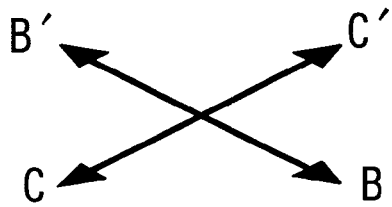
Figure 3:
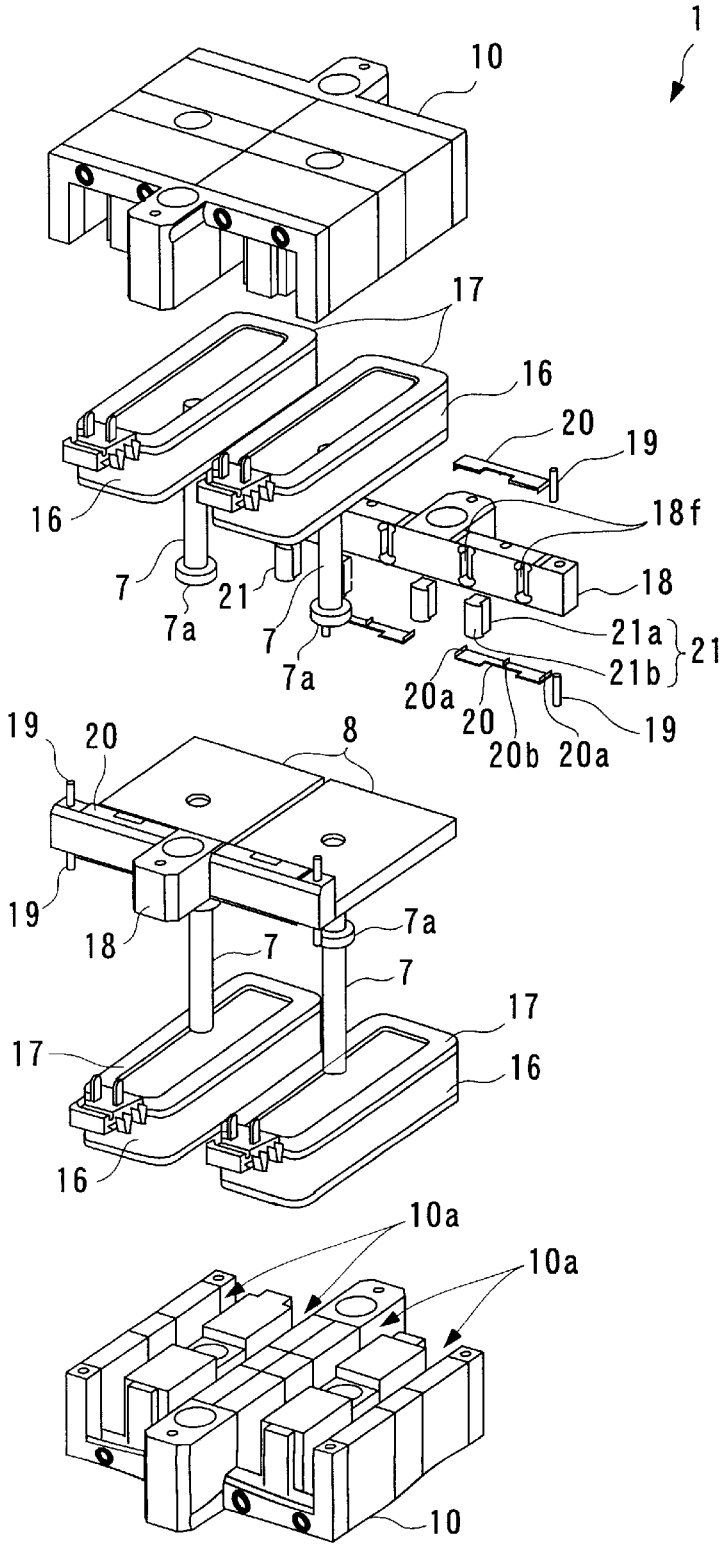
FIG. 3 is an exploded perspective view of FIG. 2 solenoid actuator.

As shown in FIGS. 1 to 3, the solenoid actuator 1 has its front and rear halves constructed symmetrically to each other in the front-rear direction, and the two intake valves 3, 3 are driven by the respective front and rear halves of the solenoid actuator 1. More specifically, the solenoid actuator 1 includes a casing la (see FIG. 1) mounted in the cylinder head 2, upper and lower electromagnets 1*b*, 1*b* arranged within the casing la with a predetermined distance therebetween, two armatures 8, 8 arranged within a space between the upper and lower electromagnets 1*b*, 1*b* in a vertically slidable manner, two upper coil springs 5, 5 (only one of them is shown in FIG. 1) for constantly urging the respective armatures 8, 8 downward, and two lower coil springs 6, 6 (only one of them is shown in the figure) for constantly urging the respective armatures 8, 8 upward.

Figure 7A:
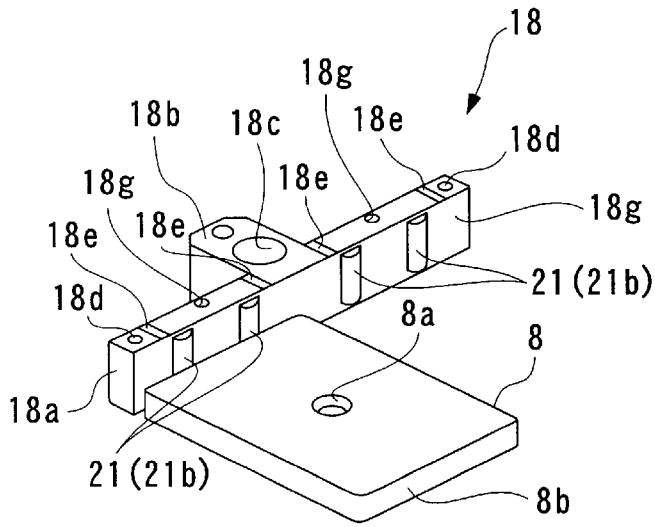
FIG. 7A is a perspective view of a joint and an armature of the FIG. 2 solenoid actuator.
Figure 7B:
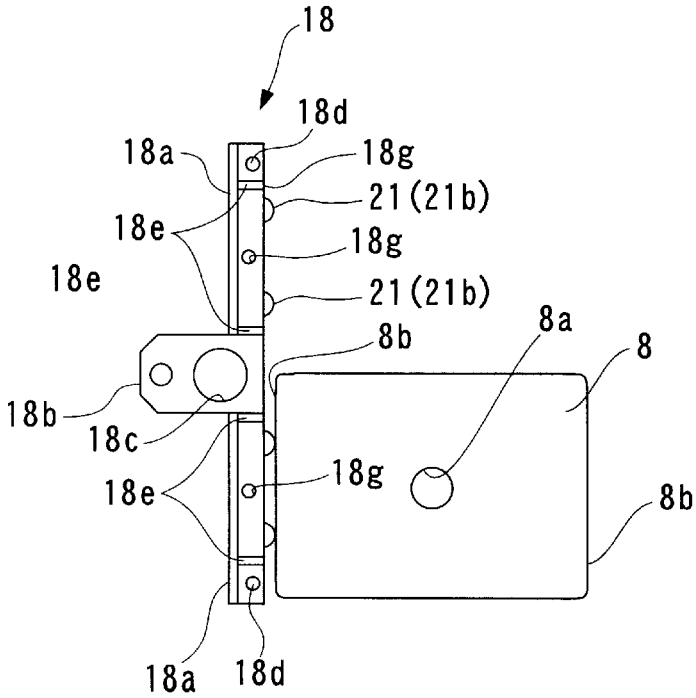
FIG. 7B is a plan view of the joint and the armature of FIG. 7A.

The armatures 8 are rectangular plates each formed of a magnetically soft material (e.g. steel) and having a round through hole 8*a* formed vertically through a center thereof as shown in FIGS. 7A and 7B. Each of the armatures 8 has left and right end faces 8*b*, 8*b* thereof held in contact with armature guides 21 of guide joints 18, referred to hereinafter. The armature 8 moves vertically in a manner guided by the armature guides 21. Further, connected to the armature 8 are upper and lower shafts 7, 7 which are round in cross section and formed of a non-magnetic austenitic stainless steel. The upper end of the lower shaft 7 and the lower end of the upper shaft 7 are fitted in the round through hole 8*a* of the armature 8. The armature 8 is supported in a sandwiched manner by flanges 7*a*, 7*a* formed on the upper and lower shafts 7, 7 at locations close to the lower and upper ends of the respective upper and lower shafts 7, 7.

The lower shaft 7 extends vertically through a guide 12*e* of a central core holder 12, referred to hereinafter, of the lower electromagnet 1*b*, and the lower end of the lower shaft 7 is connected to the upper end of the intake valve 3. Similarly, the upper shaft 7 extends vertically through a guide 12*e* of a central core holder 12 of the upper electromagnet 1*b*. The upper shaft 7 is held in contact with the upper coil spring 5 via a spring-seating member 5*a* mounted on the upper end of the upper shaft 7. The shafts 7 are guided through the guides 12*e*, respectively, whenever the armature 8 moves vertically. The intake valve 3 is held in contact with the lower coil spring 6 via a spring-seating member 6*a* mounted on the upper end of the intake valve 3.

As shown in FIGS. 2 and 3, the upper and lower electromagnets 1*b*, 1*b* are connected to each other via the guide joints 18 referred to hereinafter. The electromagnets 1*b*, 1*b* are identical in construction and arranged in a vertically symmetrical manner with the guide joints 18 interposed therebetween. In the following, description is made by taking the lower electromagnet 1*b* as an example.

Figure 4A:
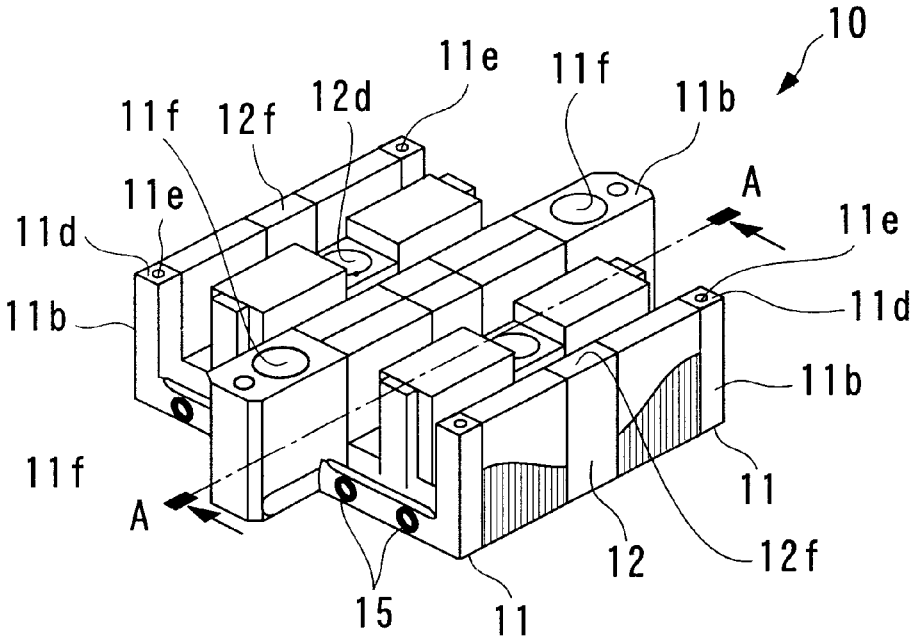
FIG. 4A is a perspective view of a core of the solenoid actuator appearing in FIG. 3.
Figure 4B:
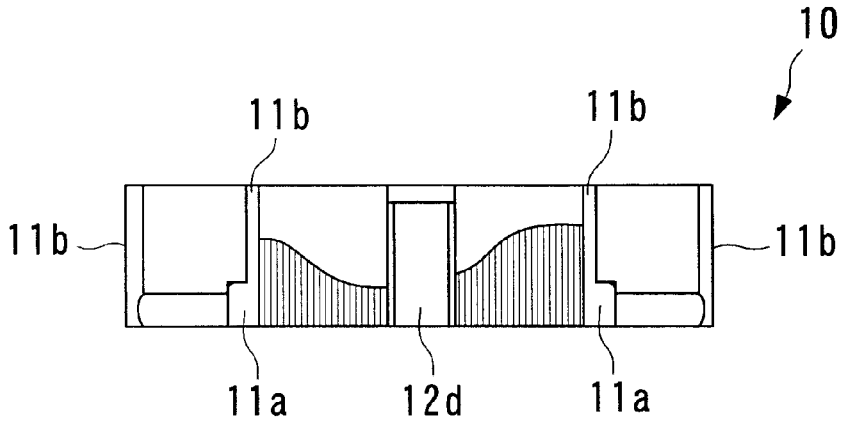
FIG. 4B is a sectional view taken on line A—A of FIG. 4A.
Figure 5:
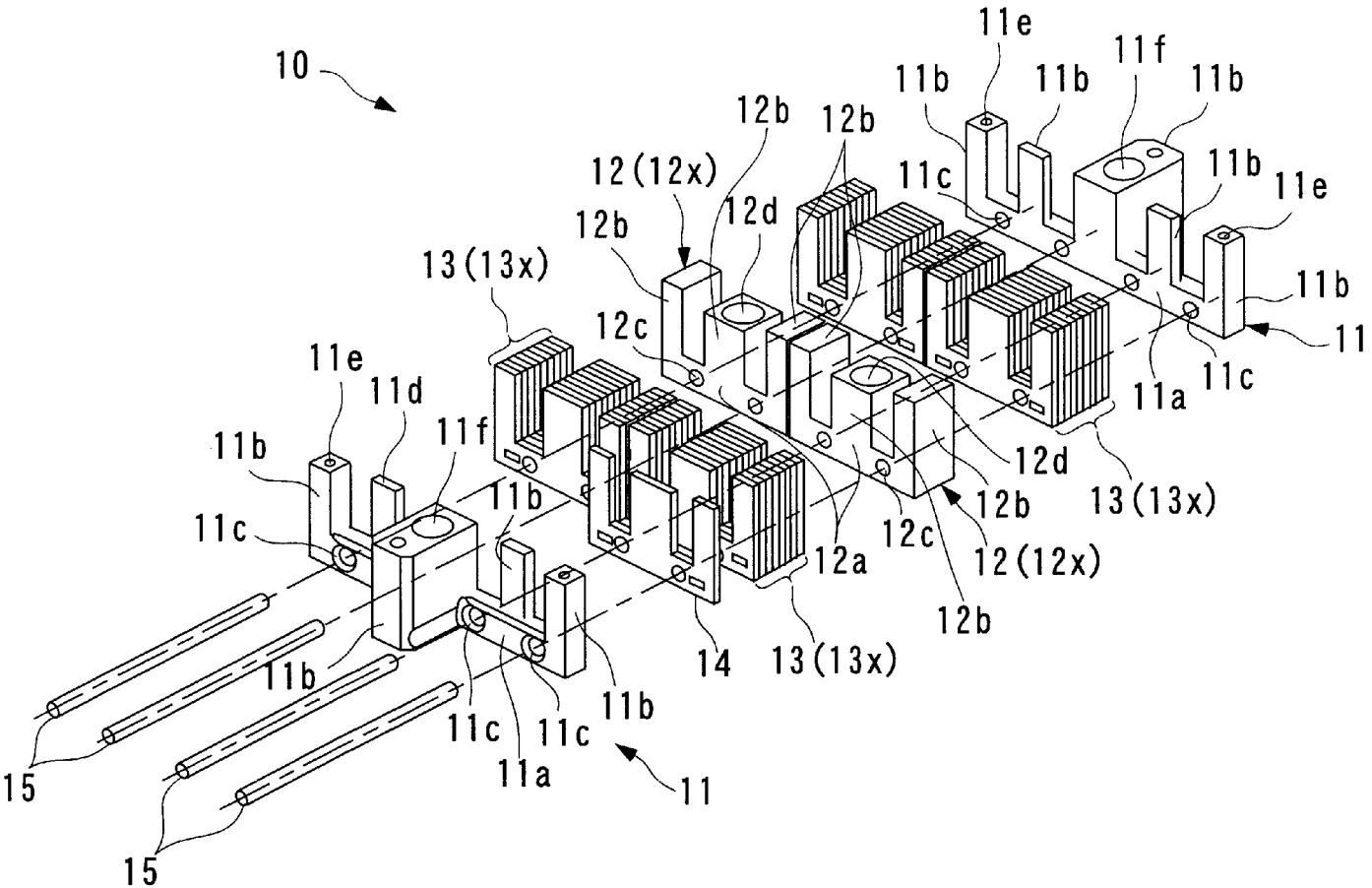
FIG. 5 is an exploded perspective view of the core shown in FIGS. 4A and 4B.

The lower electromagnet 1*b* includes a core 10 and two coils 16, 16 accommodated in respective coil grooves 10*a*, 10*a* formed in the core 10 (see FIG. 3). As shown in FIGS. 4A, 4B and 5, the core 10 is a unitary assembly formed by combining three core holders, i.e. left and right core holders 11, 11 and a central core holder 12, and left and right laminated stacks 13, 13 of core plates 14 by four rods 15.

The left and right core holders 11, 11 are each formed of the austenitic stainless steel similarly to the shafts 7. The two core holders 11, 11 are identical in construction and arranged in a manner symmetrically opposed to each other in the left-right direction. The following description is made by taking the left core holder 11 as an example. The left core holder 11 is a unitary comb-shaped member comprised of a base portion 11*a* extending in the front-rear direction and five retainer portions 11*b* each formed to have a shape of a hair comb tooth and extending upward from the base portion 11*a* to a predetermined height in a manner spaced from each other in the front-rear direction.

Each of the five retainer portions 11*b* is rectangular in cross section and has a right side face thereof flush with the right side face of the base portion 11*a*. On the other hand, the left side face of the middle retainer portion 11*b* protrudes outward or leftward with respect to the left side face of the base portion 11*a*, the left side faces of the respective front and rear retainer portions 11*b*, 11*b* are flush with that of the base portion 11*a*, and those of the inner retainer portions 11*b*, 11*b* formed between the middle retainer portion 11*b* and the respective front and rear retainer portions 11*b*, 11*b* are slightly recessed inward or rightward from the base portion 11*a*. It should be noted that the middle retainer portion 11*b* is formed by integrating a portion protruding outward or leftward from the base portion 11*a*.

Formed in respective predetermined portions of the base portion 11*a* are four through holes 11*c* each extending in the left-right direction and having a left-side opening chamfered. Further, the front and rear retainer portions 11*b* each have an upper face thereof formed with a round hole 11*e* open upward, and the middle retainer portion 11*b* is formed with a through hole 11*f* extending vertically.

The central core holder 12 is also formed of the same austenitic stainless steel as that of the core holder 11. The central core holder 12 extends in the front-rear direction and has the same length along this direction as that of the core holder 11. Further, the central core holder 12 has a comb-like shape in side view, which is substantially the same as the shape of the core holder 11. The central core holder 11 is formed by joining two holder members 12X, 12X to each other in the front-rear direction and has opposite flat side faces. Each of the holder members 12X has an E shape in cross section and has a base portion 12*a* extending in the front-rear direction, and three retainer portions 12*b*, 12*b*, 12*b* integrally formed with the base portion 12*e* and extending upward, respectively, from the front and rear ends and a central portion of the base portion 12*a*. The base portion 12*a* is formed therethrough with two through holes 12*c*, 12*c* extending in the left-right direction. The front and rear retainer portions 12*b*, 12*b* are identical in height to the retainer portions 11*b* of the core holder 11, and the middle retainer portion 12*b* is lower than the other retainer portions 12*b*, 12*b*. This enables the upper face of the central retainer portion 12*b* to serve as an indentation for receiving the flange 7*a* of the shaft 7 when the armature 8 is brought into abutment with the core 10 (see FIG. 1).

Further, the middle retainer portion 12*b* is formed therethrough with a through hole 12*d* extending vertically, in which is fitted the hollow cylindrical guide 12*e* (see FIG. 1) for guiding vertical sliding motion of the shaft 7.

The central core holder 12 is formed by joining the front retainer portion 12*b* of one of the holder members 12X, 12X constructed as above to the rear retainer portion 12*b* of the other. The two retainer portions 12*b*, 12*b* joined to each other to form the central portion of the central core holder 12 are opposed to the middle retainer portion 11*b* of the core holder 11. Similarly, the opposite front and rear retainer portions 12*b*, 12*b* of the central core holder 12 other than the two retainer portions 12*b*, 12*b* forming the central portion are opposed to the front and rear retainer portions 11*b*, 11*b* of the core holder 11, respectively, while the middle retainer portions 12*b*, 12*b* are opposed to the inner retainer portions 11*b*, 11*b*, respectively. Further, the four through holes 12*c* are identical in diameter to the four through holes 11*c* formed through the core holder 11, respectively, and each opposed to the corresponding one of the four through holes 11*c*.

Figure 6A:
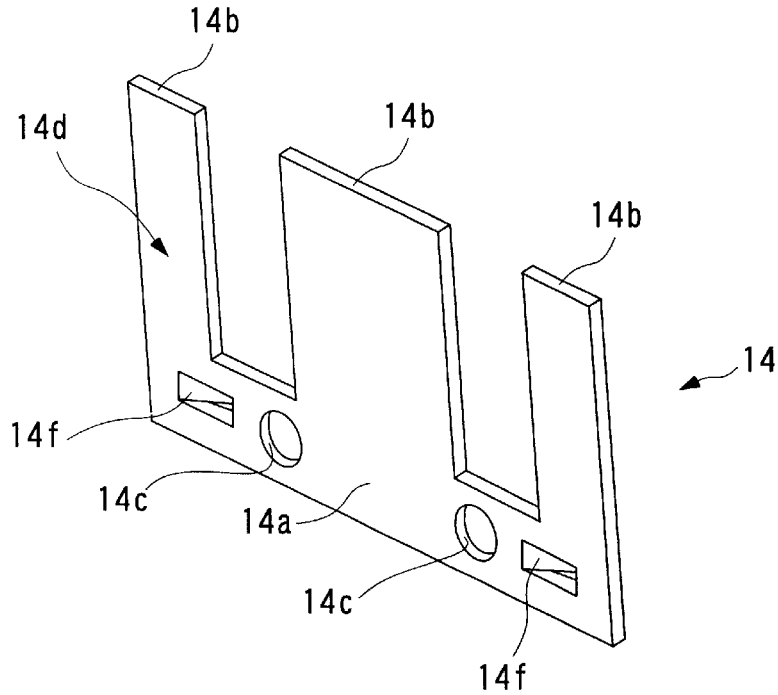
FIG. 6A is a perspective view of a core plate as a component of the core shown in FIGS. 4A and 4B.
Figure 6B:
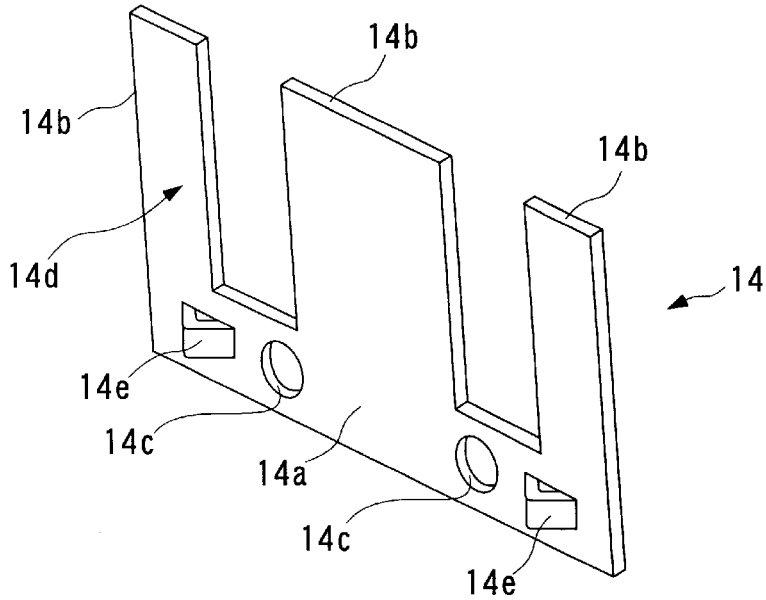
FIG. 6B is a perspective view showing the opposite side of the FIG. 6A core plate.
Figure 6C:
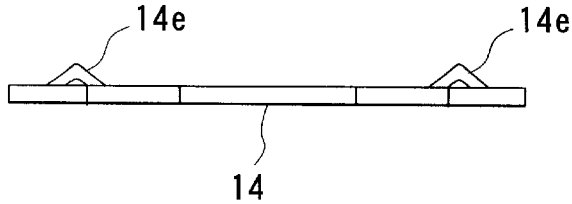
FIG. 6C is a plan view of the core plate.

The laminated stacks 13 of core plates 14 are each comprised of a pair of laminated stacks 13X, 13X of core plates 14 arranged in the front-rear direction. Each laminated stack 13X is formed by laminates of a predetermined number of core plates 14, one of which is shown in FIGS. 6A to 6C, in the left-right direction. Each core plate 14 is formed of a thin non-oriented silicon steel plate and has the whole surface thereof coated with an insulating film 14*d* e.g. of epoxy resin. Adjacent ones of the core plates 14 are insulated from each other by the insulating films 14*d*. Further, the core plate 14 is formed to have substantially the same E shape and size as those of the side face of the holder member 12X, by stamping a non-oriented silicon steel plate. More specifically, the core plate 14 is comprised of a base portion 14*a* extending in the front-rear direction and three magnetic path-forming portions 14*b*, 14*b*, 14*b* extending upward, respectively, from the front and rear ends and central portion of the base portion 14*a*, the base portion 14*a* being formed with two through holes 14*c*, 14*c* open in the left-right direction.

The three magnetic path-forming portions 14*b* are identical in height to each other, and lower than the front and rear retainer portions 12*b* of the central core holder 12 by a predetermined height (e.g. equal to or smaller than 20 $\mu$m), so that an upper face 13*a* of the laminated stack 13X is lower than the upper face 11*d* of the core holder 11 and an upper face 12*f* of the central core holder 12. The corresponding through holes 14*c* of the respective core plates 14 are continuous with each other to form a through hole extending through the laminated stack 13X in the left-right direction. Further, the through holes 14*c* are each identical in diameter to the corresponding through hole 11*c* of the core holder 11 and the corresponding through hole 12*c* of the core holder 12 and positioned in a manner concentric with the corresponding through holes 11*c* and 12*c*. Further, the base portion 14*a* is formed with two projections 14*e*, 14*e* at opposite locations slightly laterally outward of the respective through holes 14*c*, 14*c*. Each projection 14*e* having a V shape in plan view is projected rightward from the base portion 14*a*, and a recess 14*f* is formed in a reverse side of each projection 14*e*.

The projections 14*e* of one core plate 14 are each fitted in the corresponding recess 14*f* of another core plate 14 adjacent thereto in the rightward direction, whereby the core plates 14 are all held in a closely stacked state. Further, the core plate 14 positioned at the right end of the laminated stack 13X is formed not with the projections 14*e* and recesses 14*f*, but only with horizontally elongated rectangular holes, not shown, in which are fitted the respective corresponding projections 14*e* of the left-hand adjacent core plate 14. Therefore, the right end face of the laminated stack 13X is flat, so that it is in intimate contact with the central core holder 12 or the right core holder 11.

Each of the rods 15 is a round bar which is slightly smaller in diameter than the through holes 11*c*, 12*c*, 14*c*. The rods 15 are each fitted through the corresponding through holes 11*c*, 12*c*, 14*c* and extend in the left-right direction. The right and left end portions of each rod 15 projecting from the through holes 11*c*, 11*c*, respectively, are swaged on the outer end faces of the respective base portions 11*a* of the right and left core holders 11. Thus, the left-hand laminated stack 13 is sandwiched between the left core holder 11 and the central core holder 12, while the right-hand laminated stack 13 is sandwiched between the central core holder 12 and the right core holder 11, whereby these members are rigidly secured to each other to form the core 10.

The coils 16, 16 are each formed to have a horizontally elongated annular or toroidal shape and assembled with bobbins 17, 17 into a unitary assembly. Each bobbin 17 is formed of a synthetic resin and has a wall U-shaped in cross section for receiving a corresponding one of the coils 16, 16 therein. The bobbins 17, 17 are accommodated in the two coil grooves 10*a*, 10*a*, respectively. Each coil groove 10*a* is defined by the retainer portions 11*b* of the core holders 11, the retainer portions 12*b* of the central core holder 12, and the magnetic path-forming portions 14*b* of the core plates 14. Each of the coils 16, 16 is accommodated within the annular coil groove 10*a* in a manner enclosing the members positioned inside the annular coil groove 10*a*, i.e. the inner retainer portions 11*b* of the opposite core holders 11, the middle retainer portion 12*b* of the central core holder 12, and the middle magnetic path-forming portions 14*b*.

Figure 8A:
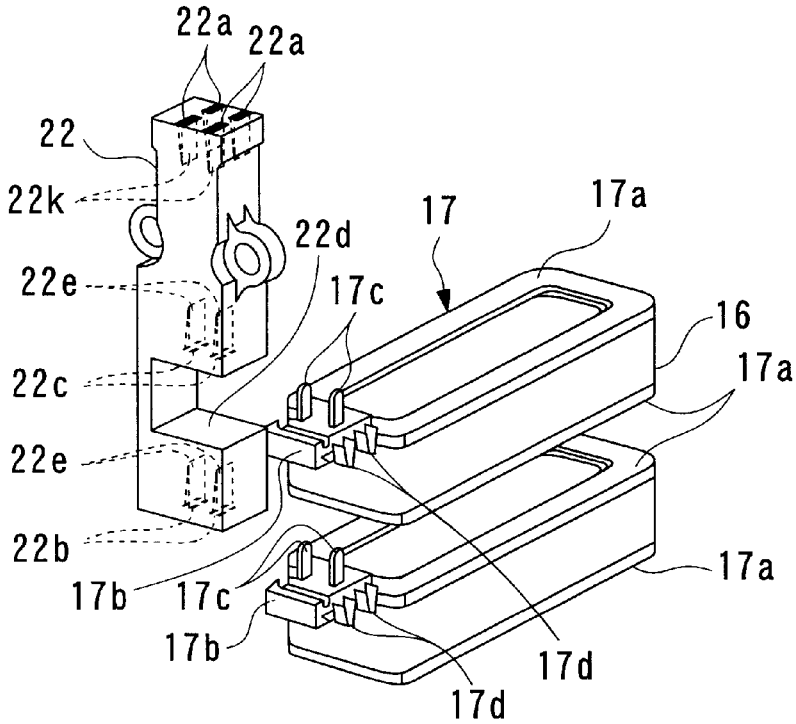
FIG. 8A is a perspective view of bobbins each bearing its associated components and a connector of the FIG. 2 solenoid actuator before they are assembled.
Figure 8B:
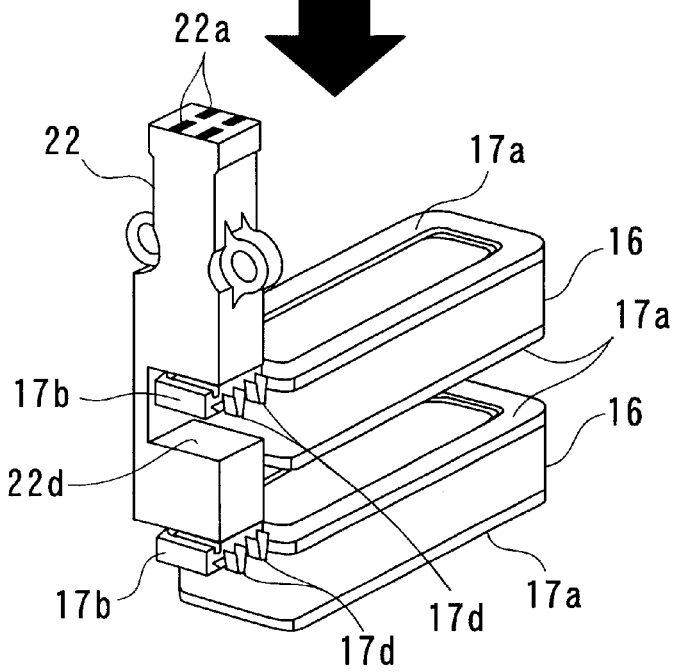
FIG. 8B is a perspective view of the bobbins each bearing its associated components and the connector of the FIG. 2 solenoid actuator after they are assembled.

As shown in FIGS. 8A and 8B, the bobbin 17 is comprised of upper and lower brims 17*a*, 17*a*, a terminal portion 17*b* projecting leftward from the left end of the upper brim 17*a*, a pair of front and rear terminals (first metal connector elements) 17*b*, 17*c* projecting upward from the terminal portion 17*b*, and a pair of V-shaped metal connectors 17*d*, 17*d* connected to the terminals 17*b*, 17*c*. The front and rear terminals 17*c*, 17*c* are each formed of an electrically conductive metal plate and arranged such that principal planes thereof are positioned in a manner parallel and opposed to each other in the front-rear direction. The coil 16 is wound around the bobbin 17 between the upper and lower brims 17*a*, 17*a*, and the ends of the coil 16 are connected to the metal connectors 17*d*, 17*d*, respectively, to be electrically connected to the respective two terminals 17*c*, 17*c*.

The lower electromagnet 1*b* is constructed as above, and the upper electromagnet 1*b* is identical in construction to the lower electromagnet 1*b*. Further, as shown in FIGS. 2, 3 and 7A, 7B, the upper and lower electromagnets 1*b*, 1*b* are joined to each other by a pair of left and right guide joints 18, 18. The two guide joints 18, 18 are arranged in a manner symmetrically opposed to each other in the left-right direction. Each of the guide joints 18 is formed of an austenitic stainless steel and extends in the front-rear direction such that it has the same length as that of the core holder 11. The guide joint 18 has substantially the same shape in plan view as that of the core holder 11. More specifically, the guide joint 18 is comprised of a base portion 18*a* extending in the front-rear direction and a protrusion 18*b* integrally formed with the base portion 18*a* and protruding outward from the central portion of the same.

The protrusion 18*b* is formed with a vertical through hole 18*c* which is identical in diameter to the through hole 11*f* of the middle retainer portion 11*b* of the core holder 11 and positioned in a manner concentric with the same.

The base portion 18*a* is identical in height to the protrusion 18*b* and has round holes 18*d*, 18*d* formed, respectively, in the opposite end portions of the upper face thereof as well as round holes 18*d*, 18*d* formed, respectively, in the opposite end portions of the lower face thereof. Each round hole 18*d* is identical in diameter and concentric with the corresponding round hole 11*e* of the core holder 11. Fitted in each of the round holes 18*d* is half of a pin 19 in the form of a round rod formed of an austenitic stainless steel, and the other half of the pin 19 is fitted in the round hole 11*e*, whereby the upper and lower cores 10, 10 are coupled to each other in a state positioned by the guide joints 18, 18.

Further, arranged on the upper face of the base portion 18*a* are front and rear coil-protecting buffer plates 20, 20 (see FIG. 3). The coil-protecting buffer plates 20, 20 are identical in shape to each other and arranged in a symmetrical manner in the front-rear direction, so that the following description will be made by taking the front coil-protecting buffer plate 20 as an example. The front coil-protecting buffer plate 20 is formed of a synthetic resin and smaller in width in the left-right direction than the base portion 18*a*. Further, the buffer plate 20 is formed with opposite end projections 20*a* and a central projection 20*b* projecting vertically (downward in this example) from the underside thereof. The base portion 18*a* has two groves 18*e* and a hole 18*g* formed at respective predetermined locations on the front-side portion of the upper face thereof, and the two opposite end projections 20*a* are fitted in the two grooves 18*e*, and the central projection 20*b* is fitted in the hole 18*g*, respectively, whereby the front coil-protecting buffer plate 20 is mounted on the base portion 18*a*. The rear coil-protecting buffer plate 20 is mounted on the base portion 18*a* in the same manner. Further, on the lower face of the base portion 18*a*, there are also mounted front and rear coil-protecting buffer plates 20, 20 in a similar manner.

Further, the four armature guides 21 are fixed to a guide surface 18*g* which is the inner surface of the guide joint 18 at predetermined space intervals, for guiding vertical reciprocating motion of the armatures 8 (see FIGS. 7A, 7B). Each armature guide 21 is formed of the austenitic stainless steel and has a fitting portion 21*a* which is rectangular in cross section and a guide portion 21*b* continuous with the fitting portion and semicircular in cross section. The guide surface 18*g* has four vertical grooves 18*f* formed at predetermined space intervals. The fitting portion 21*a* of each armature guide 21 is fitted in the corresponding vertical groove 18*f*, whereby the armature guide 21 fixed to the guide joint 18. In this state, each of the guide portions semicircular in cross section protrudes toward the armature 8 from the guide surface 18*g* and at the same time held in contact with the left end face 8*b* or the right end face 8*b* of the armature 8. Thus, the armatures 8 are each slidably guided by the corresponding ones of the armature guides 21 when they perform vertical reciprocating motion.

In a state where the upper and lower electromagnets 1*b*, 1*b* are joined to each other via the guide joints 18 constructed as above, each of the four coils 16 (bobbins 17) is vertically sandwiched by the corresponding core 10 and guide joints 18, as shown in FIG. 2, in a state of the brim 17*a* of the bobbin 17 in abutment with the corresponding coil-protecting buffer plate 20. The through hole 11*f* of each core 10 and the through hole 18*c* of each guide joint 18 extend vertically in a manner continuous with each other. A bolt, not shown, is screwed into the cylinder head 2 through these holes 11*f*, 18*c*, whereby the electromagnets 1*b*, 1*b* are rigidly fixed to the cylinder head 2.

Further, as shown in FIGS. 8A, 8B, the front (or rear) coil 16 and bobbin 17 of the upper electromagnet 1*b* and the front (or rear) coil 16 and bobbin 17 of the lower electromagnet 1*b* are arranged vertically in an identical position in plan view. The two terminals 17*b*, 17*c* of each of the two bobbins 17 are connected to a connector 22 which is generally in the form of a rectangular column. The connector 22 is formed of a synthetic resin and extends vertically.

The connector 22 has an upper end face thereof formed with four upper socket openings 22*a* each in the form of a slit and open upward, and a lower end face thereof formed with two lower socket openings 22*b*, 22*b* each identical in shape to the upper socket opening 22*a*. The two lower socket openings 22*b*, 22*b* are parallel and opposed to each other in the front-rear direction and open downward at respective locations corresponding to the terminals 17*b*, 17*c*. Further, formed in the lower end portion of the connector 22 is a cut-away portion 22*d* formed by cutting away a parallelepiped portion of the connector 22 from the front side of the same. The cut-away portion 22*d* has an upper wall thereof formed with two middle socket openings 22*c*, 22*c*. The middle socket openings 22*c*, 22*c* are open downward and identical in position in plan view to the respective lower socket openings 22*b*, 22*b*. Within each of the socket openings 22*b* to 22*c*, there is provided a metal connector (second metal connector element) 22*e* comprised of two electrically conductive metal strips arranged in a manner each extending vertically and combined such that root portions thereof are held in contact with each other and a space therebetween is increased toward the outer or forward ends thereof. The terminals 17*c* are each sandwiched by the metal strips of a corresponding one of the metal connectors 22*e* in the socket openings 22*b*, 22*c*. Further, a metal connector 22*k* (third metal connector element) similar to the metal connector 22*e* is also arranged within each of the upper socket openings 22*a*.

The metal connectors 22*k* of the front two of the four upper socket openings 22*a* are electrically connected to the respective metal connectors 22*k*, 22*k* of the middle socket openings 22*c*, 22*c*, while the metal connectors 22*k*, 22*k* of the rear two of the four upper socket openings 22*a* are electrically connected to the respective metal connectors 22*e*, 22*e* of the lower socket openings 22*b*, 22*b*. Further, a cable, not shown, having four terminals extends from a controller (power source), not shown, and the four terminals of the cable are plugged into the four socket openings 22*a*, respectively, whereby the four coils 16 are electrically connected to the controller.

Next, the work for mounting and removing the connector 22 of the solenoid actuator 1 constructed as above to the electromagnets 1*b*, 1*b* is described. First, when the connector 22 is mounted to the upper and lower electromagnets 1*b*, 1*b*, the lower socket openings 22*b* and the middle socket openings 22*c* of the connector 22 are moved to respective locations over the terminals 17*c* of the upper and lower electromagnets. Then, the connector 22 is moved downward to cause the lower socket openings 22*b* and the middle socket openings 22*c* to be fitted on the respective terminals 17*c*. This causes the metal connectors 22*e*, 22*e* within the socket openings 22*b*, 22*c* to hold the terminals 17*c* of the upper and lower electromagnets, respectively, whereby the metal connectors 22*e*, 22*e* are connected to the terminals 17*b*, 17*c* of the upper and lower electromagnets, which connects the coils 16 of the electromagnets 1*b* to the controller. Further, when the connector 22 is removed from the upper and lower electromagnets 1*b*, 1*b*, inversely to the above, it is only required to pull the connector 22 upward.

As described above, the wiring work for the coils 16, 16 of the upper and lower electromagnets 1*b*, 1*b* can be carried out only by fitting the metal connectors 22*e*, 22*e* of the connector 22 on the terminals 17*c*, 17*c* of the upper and lower electromagnets from above. Therefore, even when the space leftward of the electromagnet 1*b* is limited, the wiring work is easy. Further, the direction of connection of the connector 22 is parallel to the direction of reciprocating motion of the armature 8. Therefore, by properly setting the vertical length of the cut-away portion 22*d*, i.e. distance between upper and lower walls thereof, the length of each metal connector 22*e*, and the length of each terminal 17*c*, it is possible to accommodate variation in the vertical distance between the upper and lower electromagnets 1*b*, 1*b* among valve actuators 1 different in the valve lift amount of the intake valve 3, such that each metal connector 22*e* can be connected to a terminal 17*c* corresponding thereto. This permits a single type of connector 22 to be commonly to applied electrical wiring to the oils 16, 16, which contributes to reduction of manufacturing costs of the solenoid actuator.

In the above embodiment, the connector 22 is connected to the coils 16 by fitting the metal connectors 22*e* within the socket openings 22*b*, 22*c* of the connector 22 on the terminals 17*c* provided on the bobbins 17 of the electromagnets 1*b*. The construction for connecting the connector 22 to the coils 16 is not limited to this, but any construction is possible so long as it permits the connection between the connector 22 and the coils 16 to be effected by engagement from above. For instance, terminals may be provided on the connector 22 and socket openings containing the metal connectors may be provided in the bobbin 17.

Further, although the solenoid actuator 1 is applied to the valve-actuating mechanism of the vehicle engine, this is not limitative, but the solenoid actuator 1 can be applied to various driving units including one for driving a valve for opening and closing an EGR pipe, one for driving fuel injection valves, and others for driving various kinds of driven members of the engine.

It is further understood by those skilled in the art that the foregoing is a preferred embodiment of the invention, and that various changes and modifications may be made without departing from the spirit and scope thereof.

What is claimed is:

1. A solenoid actuator supplied with electric power from a power source, for generating an electromagnetic force to drive a driven member such that said driven member performs reciprocating motion, comprising:

two electromagnets each having a coil and arranged such that said two electromagnets are opposed to each other and spaced from each other;

an armature connected to said driven member, and arranged between said two electromagnets, for performing reciprocating motion in a reciprocating direction in accordance with energization and deenergization of said two electromagnets, to thereby drive said driven member such that said driven member performs said reciprocating motion;

two pairs of first metal connector elements, each pair of first metal connector elements connected to a respective coil of said two electromagnets, and arranged such that each pair of first metal connector elements protrude outward from a respective one of said two electromagnets; and a connector having two pairs of second metal connector elements electrically connectible to said power source, each pair of said second metal connector elements being connected to a respective pair of first metal connector elements on each one of said two electromagnets, the connector and the two pairs of first metal connector elements engage each other by relative linear movement therebetween in a direction parallel to the reciprocating direction of said reciprocating motion of said armature.

2. A solenoid actuator supplied with electric power from a power source, for generating an electromagnetic force to drive a driven member such that said driven member performs reciprocating motion, comprising:

two electromagnets each having a coil and arranged such that said two electromagnets are opposed to each other and spaced from each other;

an armature connected to said driven member, and arranged between said two electromagnets, for performing reciprocating motion in a reciprocating direction in accordance with energization and deenergization of said two electromagnets, to thereby drive said driven member such that said driven member performs said reciprocating motion;

two pairs of first metal connector elements, each pair of first metal connector elements connected to a respective coil of said two electromagnets, and arranged such that each pair of first metal connector elements protrude outward from a respective one of said two electromagnets; and a connector having two pairs of second metal connector elements electrically connectible to said power source, each pair of said second metal connector elements being connected to a respective pair of first metal connector elements on each one of said two electromagnets in a direction parallel to the reciprocating direction of said reciprocating motion of said armature, wherein said each of said two electromagnets includes a bobbin having said coil wound therearound, said two first metal connector elements being terminals arranged on said bobbin, and wherein said connector is in a form of a rectangular column and has one end face, another end face opposite to said one end face, and a cut-away portion formed by cutting away a parallelepiped portion therefrom, said cut-away portion having a wall facing toward and parallel to said another end face, said four second metal connector elements being arranged in two first openings formed in said another end face of said connector and two second openings formed in said wall facing toward said another end face.

3. A solenoid actuator supplied with electric power from a power source, for generating an electromagnetic force to drive a driven member such that said driven member performs reciprocating motion, comprising:

two electromagnets each having a coil and arranged such that said two electromagnets are opposed to each other and spaced from each other;

an armature connected to said driven member, and arranged between said two electromagnets, for performing reciprocating motion in a reciprocating direction in accordance with energization and deenergization of said two electromagnets, to thereby drive said driven member such that said driven member performs said reciprocating motion;

two pairs of first metal connector elements, each pair of first metal connector elements connected to a respective coil of said two electromagnets, and arranged such that each pair of first metal connector elements protrude outward from a respective one of said two electromagnets; and a connector having two pairs of second metal connector elements electrically connectible to said power source, each pair of said second metal connector elements being connected to a respective pair of first metal connector elements on each one of said two electromagnets in a direction parallel to the reciprocating direction of said reciprocating motion of said armature, wherein said each of said two electromagnets includes a bobbin having said coil wound therearound, said two first metal connector elements being terminals arranged on said bobbin, and wherein said connector is in a form of a rectangular column and has one end face, another end face opposite to said one end face, and a cut-away portion formed by cutting away a parallelepiped portion therefrom, said cut-away portion having a wall facing toward and parallel to said another end face, said four second metal connector elements being arranged in two first openings formed in said another end face of said connector and two second openings formed in said wall facing toward said another end face, and said connector has four third openings formed in said one end face, said third openings having third metal connector elements respectively arranged therein, said third metal connector elements being electrically connected respectively to two of said four second metal connector elements arranged within said two first openings and two of said four second metal connector elements arranged within said two second openings, said third openings receiving respective terminals of a cable connected to said power source.

4. A solenoid actuator supplied with electric power from a power source, for generating an electromagnetic force to drive a driven member such that said driven member performs reciprocating motion, comprising:

two electromagnets each having a coil and arranged such that said two electromagnets are opposed to each other and spaced from each other;

an armature connected to said driven member, and arranged between said two electromagnets, for performing reciprocating motion in a reciprocating direction in accordance with energization and deenergization of said two electromagnets, to thereby drive said driven member such that said driven member performs said reciprocating motion;

two pairs of first metal connector elements, each pair of first metal connector elements connected to a respective coil of said two electromagnets, and arranged such that each pair of first metal connector elements protrude outward from a respective one of said two electromagnets; and a connector having two pairs of second metal connector elements electrically connectible to said power source, each pair of said second metal connector elements being connected to a respective pair of first metal connector elements on each one of said two electromagnets in a direction parallel to the reciprocating direction of said reciprocating motion of said armature, wherein said each of said two electromagnets includes a bobbin having said coil wound therearound, said two first metal connector elements being terminals arranged on said bobbin, and wherein said connector is in a form of a rectangular column and has one end face, another end face opposite to said one end face, and a cut-away portion formed by cutting away a parallelepiped portion therefrom, said cut-away portion having a wall facing toward and parallel to said another end face, said four second metal connector elements being arranged in two first openings formed in said another end face of said connector and two second openings formed in said wall facing toward said another end face, said connector has four third openings formed in said one end face, said third openings having third metal connector elements respectively arranged therein, said third metal connector elements being electrically connected respectively to two of said four second metal connector elements arranged within said two first openings and two of said four second metal connector elements arranged within said two second openings, said third openings receiving respective terminals of a cable connected to said power source, and said bobbin has a first brim having an end and second brim, as well as a terminal portion projecting outward from said end of said first brim having an end, and a second brim, as well as a terminal portion projecting outward from said end of said first brim, and wherein said terminals arranged on said bobbin project perpendicularly from said terminal portion.

* * * * *